US007075243B2

(12) United States Patent
Park

(10) Patent No.: US 7,075,243 B2
(45) Date of Patent: Jul. 11, 2006

(54) DRIVING APPARATUS FOR PLASMA DISPLAY PANEL AND GRAY LEVEL EXPRESSING METHOD THEREOF

(75) Inventor: Seung-Ho Park, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 0 days.

(21) Appl. No.: 10/966,535

(22) Filed: Oct. 14, 2004

(65) Prior Publication Data

US 2005/0088107 A1 Apr. 28, 2005

(51) Int. Cl.
*G09G 3/10* (2006.01)

(52) U.S. Cl. ..... 315/169.4; 345/60; 345/63; 345/68; 315/169.3

(58) Field of Classification Search ..... 315/169.4
See application file for complete search history.

(56) References Cited

U.S. PATENT DOCUMENTS 6,100,863 A * 8/2000 Zhu ..... 345/89
6,965,358 B1 * 11/2005 Kasahara et al. ..... 345/63
2002/0190927 A1 * 12/2002 Shoji et al. ..... 345/60
2003/0048242 A1 * 3/2003 Jeong et al. ..... 345/63
2003/0058476 A1 * 3/2003 Kwon et al. ..... 358/3.02
2003/0151565 A1 * 8/2003 Kim et al. ..... 345/60

* cited by examiner

*Primary Examiner*—Trinh Dinh
*Assistant Examiner*—Binh Van Ho
(74) *Attorney, Agent, or Firm*—Christie, Parker and Hale, LLP

(57) ABSTRACT

A PDP driving apparatus and a gray level expressing method thereof that improves the expression of the gray level and reduces pseudo-contour. The average signal level of one frame data of an input image signal is calculated to determine a sustain pulse number, and an inverse gamma correction gray level corresponding to the sustain pulse numbers is expressed with reference to inverse gamma correction tables selected according thereto. The sustain pulse numbers determined according to the signal level are divided into a plurality of groups, and then are converted to the subfields depending on the sustain pulse numbers corresponding to the respective groups. In that situation, the sustain pulse numbers at the subfields corresponding to the respective groups are different from each other.

12 Claims, 8 Drawing Sheets

FIG.9

| Maximum pulse number | Maximum gray level number | Dividing number | sf1 | sf2 | sf3 | sf4 | sf5 | sf6 | sf7 | sf8 | sf9 | sf10 | sf11 | sf12 | sf13 | sf14 | sf15 | sf16 |
|---|---|---|---|---|---|---|---|---|---|---|---|---|---|---|---|---|---|---|
| 511 | 512 | 9 | 1 | 2 | 4 | 8 | 16 | 32 | 64 | 128 | 256 | | | | | | | |
| 1023 | 1024 | 10 | 1 | 2 | 4 | 8 | 16 | 32 | 64 | 128 | 256 | 512 | | | | | | |
| 2047 | 2048 | 11 | 1 | 2 | 4 | 8 | 16 | 32 | 64 | 128 | 256 | 512 | 1024 | | | | | |
| 4095 | 4096 | 12 | 1 | 2 | 4 | 8 | 16 | 32 | 64 | 128 | 256 | 512 | 1024 | 2048 | | | | |
| 8191 | 8192 | 13 | 1 | 2 | 4 | 8 | 16 | 32 | 64 | 128 | 256 | 512 | 1024 | 2048 | 4096 | | | |
| 16383 | 10384 | 14 | 1 | 2 | 4 | 8 | 16 | 32 | 64 | 128 | 256 | 512 | 1024 | 2048 | 4096 | 8192 | | |
| 32767 | 32768 | 15 | 1 | 2 | 4 | 8 | 16 | 32 | 64 | 128 | 256 | 512 | 1024 | 2048 | 4096 | 8192 | 16384 | |
| 65535 | 65536 | 16 | 1 | 2 | 4 | 8 | 16 | 32 | 64 | 128 | 256 | 512 | 1024 | 2048 | 4096 | 8192 | 16384 | 32768 |

FIG.10

| | sf1 | sf2 | sf3 | sf4 | sf5 | sf6 | sf7 | sf8 | sf9 | sf10 |
|---|---|---|---|---|---|---|---|---|---|---|
| Gray level | 1 | 2 | 4 | 8 | 16 | 32 | 64 | 128 | 256 | 512 |
| 0 | × | × | × | × | × | × | × | × | × | × |
| 1 | ○ | × | × | × | × | × | × | × | × | × |
| 2 | × | ○ | × | × | × | × | × | × | × | × |
| 3 | ○ | ○ | × | × | × | × | × | × | × | × |
| ••• | | | | | | | | | | |
| 511 | ○ | ○ | ○ | ○ | ○ | ○ | ○ | ○ | ○ | × |
| 512 | × | × | × | × | × | × | × | × | × | ○ |
| ••• | | | | | | | | | | |
| 1022 | × | ○ | ○ | ○ | ○ | ○ | ○ | ○ | ○ | ○ |
| 1023 | ○ | ○ | ○ | ○ | ○ | ○ | ○ | ○ | ○ | ○ |

FIG.11

| | sf1 | sf2 | sf3 | sf4 | sf5 | sf6 | sf7 | sf8 | sf9 | sf10 |
|---|---|---|---|---|---|---|---|---|---|---|
| Arrangement A | 1 | 2 | 4 | 8 | 16 | 32 | 64 | 128 | 256 | 512 |
| Arrangement B | 1 | 2 | 4 | 8 | 16 | 32 | 60 | 100 | 160 | 256 |

FIG.12

| | sf1 | sf2 | sf3 | sf4 | sf5 | sf6 | sf7 | sf8 | sf9 | sf10 |
|---|---|---|---|---|---|---|---|---|---|---|
| Gray level | 1 | 2 | 4 | 8 | 16 | 32 | 60 | 100 | 160 | 256 |
| 0 | × | × | × | × | × | × | × | × | × | × |
| 1 | ○ | × | × | × | × | × | × | × | × | × |
| 2 | × | ○ | × | × | × | × | × | × | × | × |
| 3 | ○ | ○ | × | × | × | × | × | × | × | × |
| ... | | | | | | | | | | |
| 638 | × | ○ | ○ | ○ | ○ | ○ | ○ | ○ | ○ | ○ |
| 639 | ○ | ○ | ○ | ○ | ○ | ○ | ○ | ○ | ○ | ○ |

DRIVING APPARATUS FOR PLASMA DISPLAY PANEL AND GRAY LEVEL EXPRESSING METHOD THEREOF

CROSS REFERENCE TO RELATED APPLICATION

This application claims priority to and the benefit of Korea Patent Application No. 10-2003-0072353 filed on Oct. 16, 2003 in the Korean Intellectual Property Office, the entire content of which is incorporated herein by reference.

BACKGROUND OF THE INVENTION (a) Field of the Invention

The present invention relates to a driving apparatus for a plasma display panel (PDP) and a gray level expressing method thereof, and more particularly, to a driving apparatus for a plasma display panel and a gray level expressing method thereof that can provide an improved expression of gray level and a reduction of pseudo-contour.

(b) Description of the Related Art

Flat displays, such as a liquid crystal display (LCD), a field emission display (FED), a plasma display panel, or the like, have been developed recently. Among the flat displays, the plasma display panel has an advantage in that it has a wide visual range and the brightness and light-emitting efficiency are high in comparison with other types of flat displays. The plasma display panel is in the spotlight as a display that can be substituted for the conventional cathode ray tube (CRT), especially in the large-sized displays of greater than forty inches.

The plasma display panel is a flat display that can display characters or images with plasma generated by gas discharge, on which hundreds of thousands or millions of pixels are arranged in a matrix format according to the size thereof. Such a plasma display panel is classified as a direct current type and an alternating current type according to the structure of discharging cells and the shape of the waveform of the driving voltage applied thereto.

The direct current type plasma display panel has a shortcoming in that a current flows in a discharge space while the voltage is being applied as the electrodes are exposed to the outside while the discharge space is not insulated, and for such a reason, a resistor for confining the current has to be prepared. On the other hand, the alternating current type plasma display panel has an advantage in that the current is confined by a capacitance formed naturally and the electrodes are protected by the impact from ions during the discharge by the dielectric layer covering the electrodes, so the lifetime is longer than that of the direct current type.

FIG. 1 is a partial perspective view of the alternating current type plasma display panel. As shown in FIG. 1, scan electrodes 4 and sustain electrodes 5 covered by dielectric layer 2 and protection layer 3 are formed in parallel in pairs on glass substrate 1. A plurality of address electrodes 8 covered by insulation layer 7 are formed on another glass substrate 6. Partitioning walls 9 are formed in parallel with address electrodes 8 on insulation layer 7 between address electrodes 8, and fluorescent substances 10 are formed on the surface of insulating layer 7 and both sides of partitioning walls 9. Glass substrates 1, 6 face to each other with discharge spaces 11 between them so that scan electrodes 4 and sustain electrodes 5 are perpendicular to address electrodes 8. Discharge spaces near intersections between address electrodes 8 and scan electrodes 4 and sustain electrodes 5 that are paired with each other form discharge cells 12.

FIG. 2 shows the arrangement of the electrodes in the plasma display panel. As shown in FIG. 2, the electrodes in the plasma display panel are arranged in m×n matrix form, and more particularly, address electrodes A1–Am are arranged in a column direction and n rows of the scan electrodes Y1–Yn and the sustain electrodes X1–Xn are arranged alternately in a row direction. Discharge cell 12 in FIG. 2 corresponds to the discharge cell 12 in FIG. 1.

The driving period of such an alternating type plasma display panel consists of a reset time, an addressing time, and a sustain time according to the time flow of the change of the operation.

The reset time is the period to initialize the status of the respective cells in order to enhance the performance of the addressing operation of the cells, and the addressing time is the period to form a wall charge by applying the address voltage to the cells to be turned on (addressed cell) in order to select the cells to be turned on and not to be turned on in the panel. The sustain time is the discharge period for displaying the image actually on the addressed cells by applying sustain pulses.

As shown in FIG. 3, the plasma display panel realizes a gray level by dividing one frame (1TV field) into a plurality of subfields and then performing time-divisional control thereon. The respective subfields consist of the reset time, the addressing time, and the sustain time as described above. FIG. 3 shows the case in which one frame is divided into eight subfields in order to realize 256 gray levels. The respective subfields SF1–SF8 consist of a reset time (not shown), addressing time Ad1–Ad8, and sustain time S1–S8, and in the sustain time S1–S8, the ratio of illuminating times 1T, 2T, 4T . . . , and 128T is 1:2:4:8:16:32:64:128.

In such a situation, in order to realize the gray level of 3 for example, the sum of the discharging time is made to be 3T by discharging the discharge cells at subfield SF1 having illuminating time 1T and subfield SF2 having illuminating time 2T. The image of 256 gray levels can therefore be realized by combining the subfields having different illuminating times.

Furthermore, according to the conventional method of expressing the gray level of the plasma display panel, the number of pulses allotted to the respective subfields is determined by a multiple of the subfield weight corresponding to the sustain time as shown in FIG. 3 according to the average gray level at every frame. In other words, the number of sustain pulses is changed according to the average gray level of every frame in order to increase the contrast between the frames and simultaneously decrease the power consumption. For example, to express 256 gray levels, four times the subfield weight is employed in the case of a low average gray level in order to assign many sustain pulses, and two times the subfield weight is employed in the case of a high average gray level in order to assign a small number of sustain pulses. Therefore, the conventional method is limited in enhancing the expression of the gray level since the gray level is expressed only by increasing the total sum of the sustain by multiplying a certain number to the subfield weight determined only in consideration of the gray level irrespective of the sustain pulse number.

In addition, while a moving picture is being displayed according to such a subfield method, pseudo-contour is generated due to the visual characteristics of a person. FIG. 4 shows an example of generated pseudo-contour. When an image in which gray level 127 and gray level 128 exist adjacently is moving rightward, such a status is expressed as FIG. 4 according to the subfield arrangement of FIG. 3. In such a situation, a human recognizes the gray levels in the direction of the dashed arrows shown in FIG. 4 according to the characteristics of the visual sense of the person that follows the movement of the image. Thus, a pseudo-contour such as the gray level 255 between the positions of gray levels 127 and 128 may occur.

SUMMARY OF THE INVENTION

In accordance with the present invention a driving apparatus for a plasma display panel and a method for expressing gray level thereof is provided, in which pseudo-contour is reduced and the expression of the gray level is improved by expressing the gray levels as many as a maximum number of sustain pulses.

In one aspect of the present invention, there is provided a driving apparatus for a plasma display panel that divides respective fields of an image displayed on the plasma display panel according to an input image signal into a plurality of subfields and displays the image corresponding to the image signal by expressing gray levels according to a combination of the subfields, the driving apparatus including: a sustain pulse number determining portion, an inverse gamma corrector, a sustain pulse subfield converter, and a sustain/scan driver. The sustain pulse number determining portion determines a sustain pulse number based on an average signal level of data in one frame of the input image signal. The inverse gamma corrector performs inverse gamma correction of the input image signal so that an inverse gamma correction gray level corresponding to the number of sustain pulses applied to the plasma display panel is expressed, by using a plurality of gamma correction tables corresponding to the sustain pulse number determined by the sustain pulse number determining portion. The sustain pulse subfield converter converts the subfield into the subfield depending on the sustain pulse number corresponding to the data output from the inverse gamma corrector by making the sustain pulse number in the respective subfields different from each other according to the sustain pulse number determined by the sustain pulse number determining portion. The sustain/scan driver generates control signals based on arrangement of the subfield converted by the sustain pulse subfield converter and applies the control signals to the plasma display panel.

According to another aspect of the present invention, there is provided a method for expressing gray levels of a plasma display panel that divides respective fields of an image displayed on the plasma display panel according to an input image signal into a plurality of subfields and displays the image corresponding to the image signal by expressing gray levels according to a combination of the subfields. In the method: (a) a sustain pulse number is determined based on an average signal level of data in one frame of the input image signal, (b) inverse gamma correction of the input image signal is performed so that an inverse gamma correction gray level corresponding to the number of sustain pulses applied to the plasma display panel is expressed, by using a plurality of gamma correction tables corresponding to the sustain pulse number determined in (a), (c) the subfield is converted into the subfield depending on the sustain pulse number corresponding to output data that have undergone the inverse gamma correction in (b), by making the sustain pulse number in the respective subfields different from each other according to the sustain pulse number determined in (a); and (d) a control is performed so that an image corresponding to the subfield data generated in (c) is displayed on the plasma display panel.

BRIEF DESCRIPTION OF THE DRAWINGS

FIG. 9 shows the maximum sustain pulse number and the maximum gray level number that can be expressed in each of the dividing numbers of the subfield, and the sustain pulse numbers in each subfield.

FIG. 10 shows a coding table of a subfield arrangement when the sustain pulse number is 1023.

FIG. 11 shows an example of the sustain pulse subfield arrangement in the respective sustain pulse subfield converters.

FIG. 12 shows a coding table at the sustain pulse subfield arrangement that expresses 639 sustain pulses.

DETAILED DESCRIPTION

Figure 1:
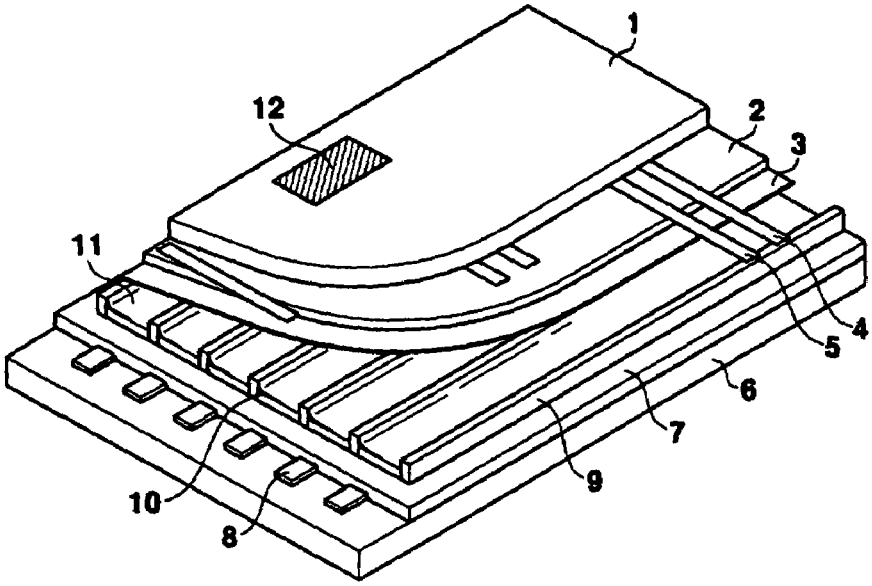
FIG.1 (Prior Art)
FIG. 1 is a partial perspective view of an alternating current type plasma display panel.
Figure 2:
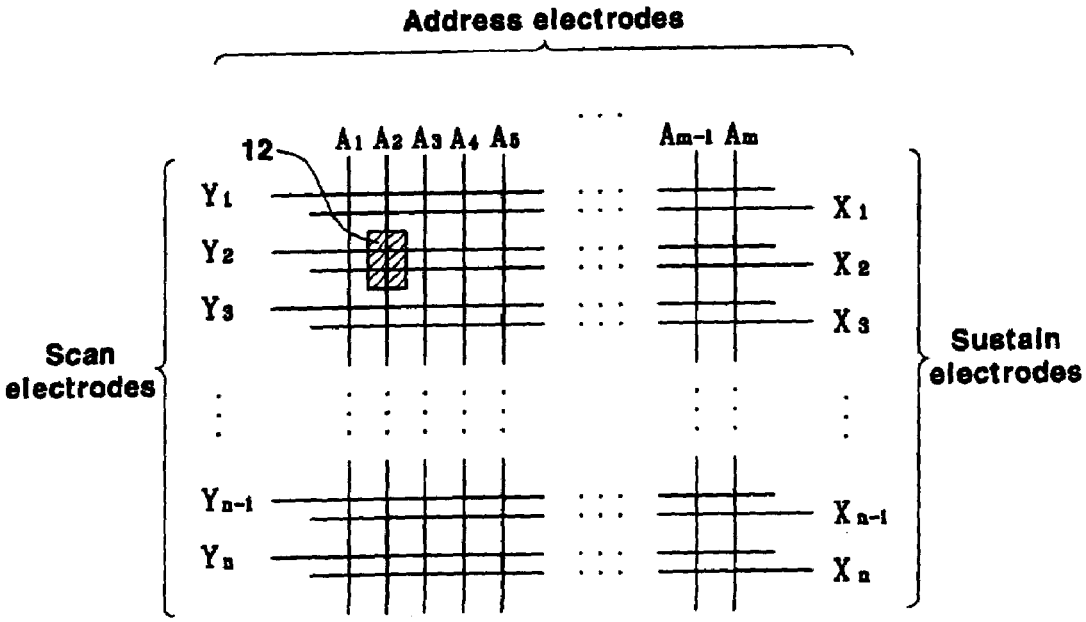
FIG.2 (Prior Art)
FIG. 2 is a schematic depiction of the electrode arrangement of an alternating current type plasma display panel.
Figure 3:
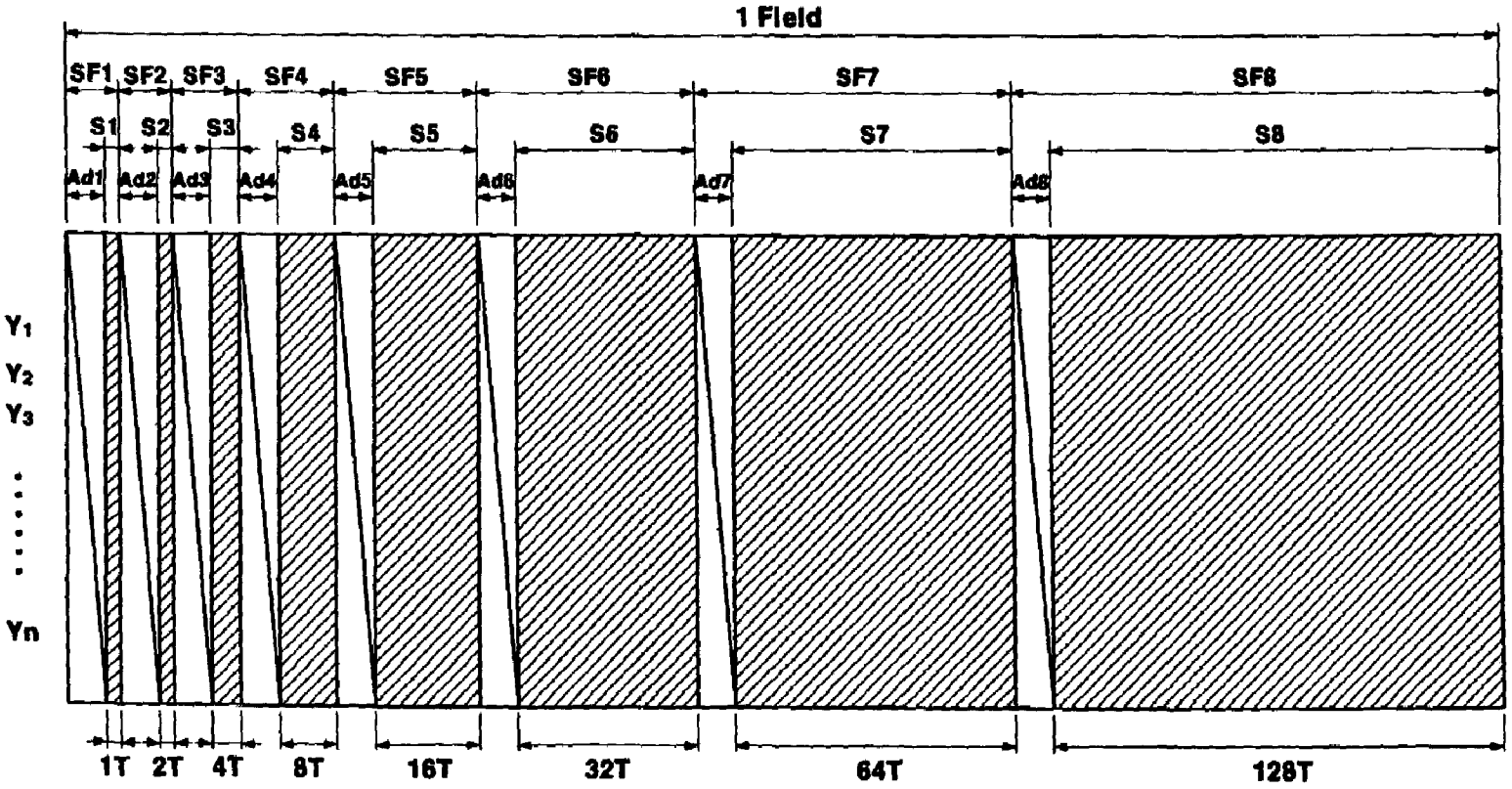
FIG.3 (Prior Art)
FIG. 3 shows a conventional gray level expressing method of a plasma display panel.
Figure 4:
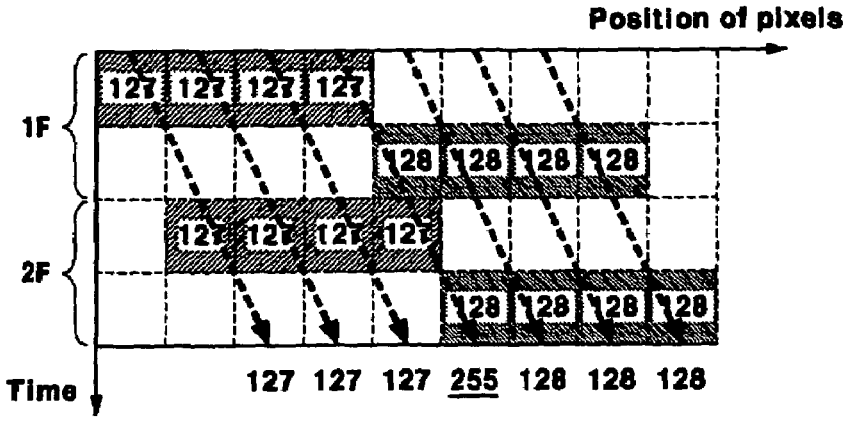
FIG.4 (Prior Art)
FIG. 4 shows an example of pseudo-contour actually generated.
Figure 5:
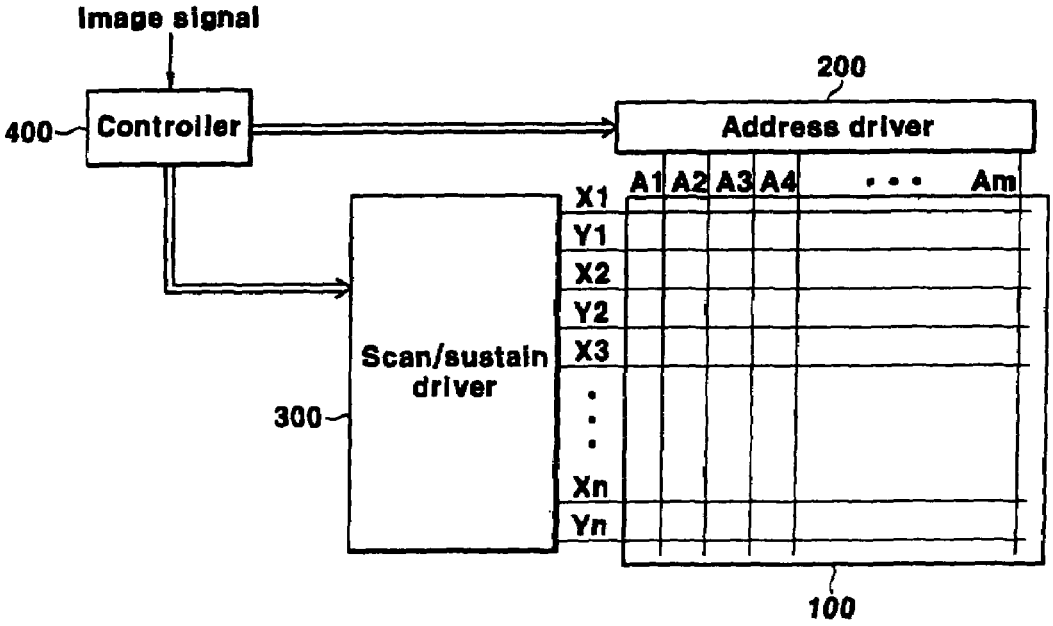
FIG. 5 is a schematic view of a plasma display panel according an exemplary embodiment of the present invention.

FIG. 5 is a schematic plan view of a plasma display panel according to an exemplary embodiment of the present invention. As shown in FIG. 5, the plasma display panel according to the exemplary embodiment includes plasma panel 100, address driver 200, scan/sustain driver 300, and controller 400.

Plasma display panel 100 includes a plurality of address electrodes A1–Am arranged in a column direction, and a plurality of scan electrodes Y1–Yn and sustain electrodes X1–Xn arranged in a row direction alternately to each other. Address driver 200 receives the address driving control signals from controller 400, and applies display data signals for selecting discharge cells to be illuminated to the respective address electrodes A1–Am. Scan/sustain driver 300 receives the control signals from the controller 400 and inputs the sustain voltages to the scan electrodes Y1–Yn and the sustain electrodes X1–Xn to perform the sustain discharge with respect to the selected discharge cells.

Controller 400 receives Red/Green/Blue (R/G/B) image signals and synchronization signals from the outside and divides one frame into several subfields, and then divides the respective subfields into a reset time, addressing time and sustain/discharge time to drive the plasma display panel. In such a situation, controller 400 adjusts the number of sustain pulses applied in each of the sustain times of the subfields in one frame so as to supply address driver 200 and scan/sustain driver 300 with the required control signal.

Controller 400 according to the exemplary embodiment of the present invention will now be described in greater detail with reference to FIGS. 6 through 12.

Figure 6:
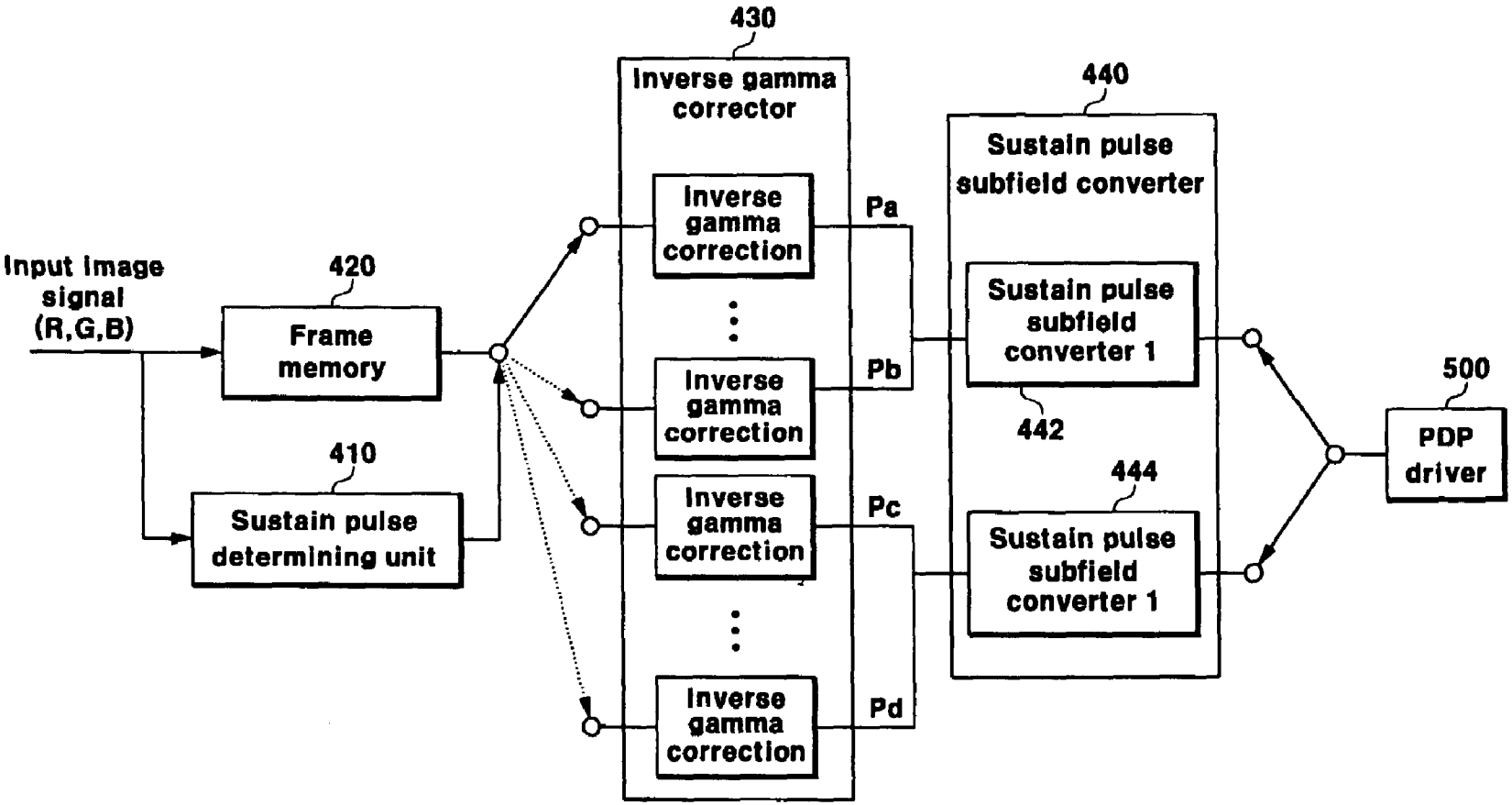
FIG. 6 is a schematic block diagram of the controller of the plasma display panel according to an exemplary embodiment of the present invention.

FIG. 6 is a schematic block diagram of controller 400 of plasma display panel according to an exemplary embodiment of the present invention. As shown in FIG. 6, the controller of the plasma display panel according to the an exemplary embodiment of the present invention includes sustain pulse number determining portion 410, frame memory 420, inverse gamma corrector 430, and sustain pulse subfield converter 440.

Sustain pulse number determining portion 410 determines the number of sustain pulses at every frame of the input image signal. That is, sustain pulse number determining portion 410 determines the maximum sustain pulse number in consideration of the luminance and power consumption. The average signal level (ASL) at every frame is calculated in order to determine the sustain pulse number by the following Equation (1).

$$ASL = \sum_{x=1}^{N}\sum_{y=1}^{M}\frac{R_{x,y}+G_{x,y}+B_{x,y}}{3\times N\times M} \quad \text{[Equation (1)]}$$

In the above equation (1), $R_{x,y}$, $G_{x,y}$, and $B_{x,y}$ respectively designate the R/G/B gray levels at the position x,y, and N and M respectively designate the horizontal and vertical size of the frame. Sustain pulse number determining portion 410 determines the sustain pulse number at every frame of the input image signal differently from each other in consideration of the aspect of the luminance and the power consumption through the average signal level ASL calculated by the equation (1).

Figure 7:
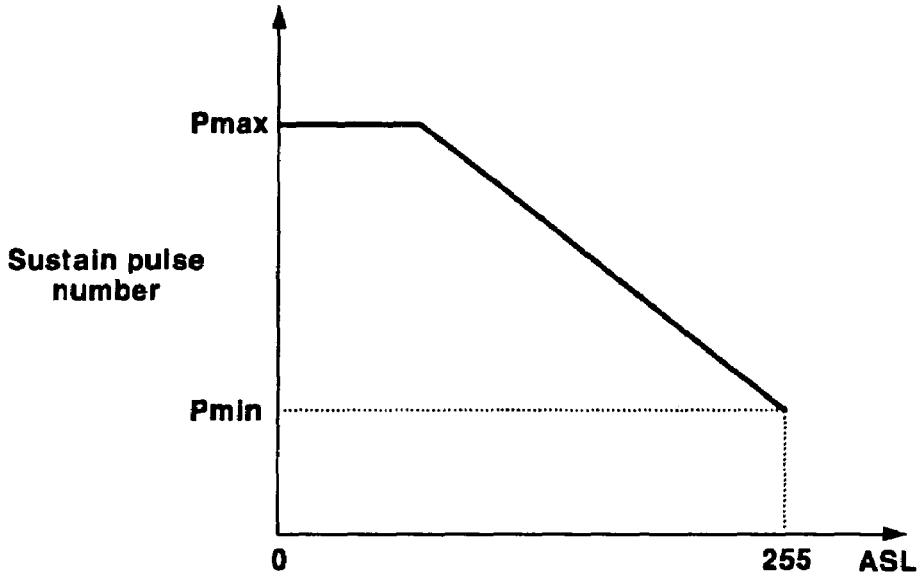
FIG. 7 is a graph showing an example of a relationship between the average signal level of frames and the number of the sustain.

FIG. 7 is a graph showing an example of the relationship between the average signal level of frames and the number of the sustain pulses used in such a situation. As shown in FIG. 7, a large number of sustain pulses are used to enhance the peak luminance if the average gray level of frames is low, and small number of sustain pulses are used to reduce the power consumption if the average gray level is high.

In this situation, the number of expressed gray levels is reduced if the sustain pulse number used is reduced. However, as shown in FIG. 9, the sustain pulse number is reduced mainly at the image of a bright average gray level, and the sustain pulse number is increased in a dark image that bears frequent problems in expressing the gray level, by which the expression of the gray level is more improved.

Inverse gamma corrector 430 performs the inverse gamma correction according to the sustain pulse number (which is determined by the average signal level of the input image signal) determined by sustain pulse determining portion 410 with reference to a plurality of inverse gamma correction look-up tables, so that the inverse gamma correction gray level corresponding to the sustain pulse number is expressed. In other words, one among the plurality of look-up tables (which mean gamma curves (SP1, SP2, . . . , SPn)) is selected as required according to the sustain pulse number determined by sustain pulse determining portion 410, and then the inverse gamma correction is performed so that the inverse gamma correction gray level corresponding to the sustain pulse number is expressed. In such a situation, the inverse gamma correction can be performed either by the inverse gamma correction tables or by a calculation.

Figure 8:
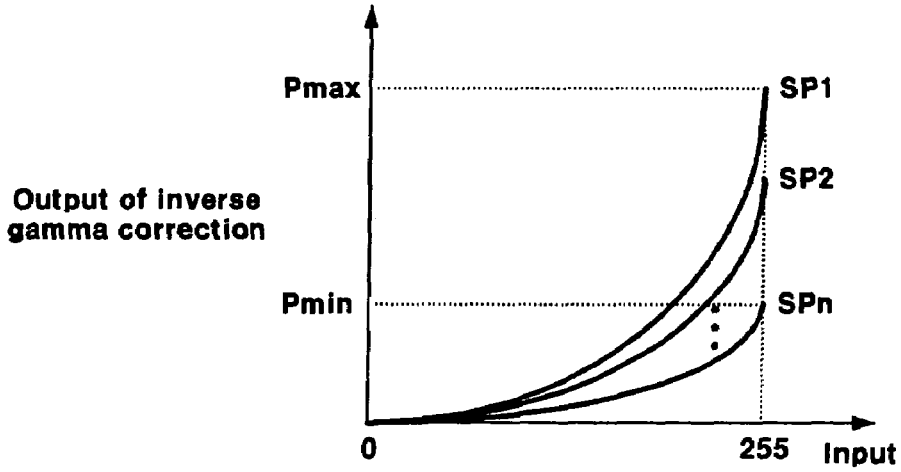
FIG. 8 is a graph showing an example in which an inverse gamma corrector has changed the inverse gamma correction table according to the number of sustain pulses.

FIG. 8 is a graph showing an example in which inverse gamma corrector 430 has changed the inverse gamma correction table according to the number of sustain pulses. As shown in FIG. 8, if the sustain pulse number is maximum Pmax, the inverse gamma correction is performed with reference to inverse gamma correction look-up table SP1. In other words, the inverse gamma correction is performed by selecting one of the different inverse gamma curves according to the sustain pulse number.

In such a situation, the image signal input to inverse gamma corrector 430 is a digital signal, so the analog image signal has to be converted to a digital signal by an analog-to-digital converter (not shown) when the analog image signal is input to the plasma display panel. Inverse gamma corrector 430 can include a logic circuit (not shown) for logically generating data corresponding to the inverse gamma curve or the look-up table (not shown) that stores the data corresponding to the inverse gamma curve for the mapping of the image signal.

Frame memory 420 stores and delays the data of the frame input at present by as much as the time required for sustain pulse number determining portion 410 to determine the sustain pulse number.

Sustain pulse subfield converter 440 converts the inverse gamma correction gray level result corresponding to the sustain pulse number output by inverse gamma corrector 430 to the subfield depending on the sustain pulse number. In other words, the subfields have been converted in consideration of gray level in the conventional art, but the subfields are converted in consideration of the number of sustain pulses in the present invention. FIG. 9 shows the maximum sustain pulse number and the maximum gray level number that can be expressed in each of the dividing numbers of the subfield, and the sustain pulse numbers in each subfield. The arrangement of sustain pulse subfield arrangement in FIG. 9 is calculated by the following Equation (2).

$$\sum_{i=1}^{N} sf(i) = P-1 \quad \text{[Equation (2)]}$$

$$sf(n+1) \le \left\{\sum_{i=1}^{n} sf(i)\right\}+1$$

$$sf(1) = 1$$

In the above Equation (2), P designates the total sustain pulse number, and N designates the dividing number of subfield. FIG. 9 shows the subfield arrangement with respect to the sustain pulse number, which satisfies all of the equations in the Equation (2). As shown in FIG. 9, if the sustain pulse number used is 1023 and the dividing number of the subfield is 10, 1024 gray levels are expressed according to the sustain pulse subfield arrangement method. Furthermore, as shown in FIG. 9, the minimum dividing number of the subfield is determined as the sustain pulse number is determined, and for example, the dividing number has to be more than 11 if the pulse number is 1024 to 2047.

FIG. 10 shows a coding table (which designates whether the respective subfields for expressing the gray levels is to be illuminated or not) of the subfield arrangement when the sustain pulse number is 1023. As shown in FIG. 10, the respective subfields do not have weight values but have the number of sustain pulses, and the gray level is expressed according to the illumination of the respective subfields with such a sustain pulse number. In that situation, sustain pulse subfield converter 440 can express 512 sustain numbers which is the maximum sustain number according to the subfield arrangement as shown in FIG. 10. In other words, if the maximum sustain number determined by the sustain pulse number determining portion 410 is 512, sustain pulse subfield converter 440 can express with the illuminating pattern as shown in FIG. 10 where the number of subfields is 10, but it cannot express with a subfield arrangement where the number of subfields is 9.

Sustain pulse subfield converter 440 includes first sustain pulse subfield converter 442 and second sustain pulse subfield converter 444 that are different from each other, and employs different subfield converters according to the sustain pulse number. In such a situation, first sustain pulse subfield converter 442 and second sustain pulse subfield converter 444 have the same subfield dividing number, and the numbers of the sustain pulses of the respective subfields (which mean the sustain pulse numbers that the respective subfields have) are different from each other. That is aimed to reduce the pseudo-contour in the moving picture by separating the sustain pulse values of the respective subfields having a large sustain pulse number if the used sustain pulse number (which means the value output when the sustain number is determined by sustain pulse determining portion 410 and different inverse gamma corrections are employed according to the sustain number) is small.

If the total sustain pulse number used in the plasma display panel is 256–1023, i.e. Pmax is 1023 and Pmin is 256, two sustain pulse number ranges are achieved by division. Considering the two ranges as being 640 (Pa) –1023 (Pb) and 257 (Pc)–639 (Pd), respectively (which can be changed arbitrarily), first sustain pulse subfield converter 442 and second sustain pulse subfield converter 444 determine the sustain pulse subfield arrangements with respect to the respective ranges. In such a situation, the respective sustain pulse subfield converters 442, 444 have identical subfield dividing numbers. FIG. 11 shows an example of the sustain pulse subfield arrangement in the respective sustain pulse subfield converters 442, 444. In FIG. 11, the arrangement A designates the sustain pulse subfield arrangement that expresses 1023 sustain pulses, and the arrangement B designates the sustain pulse subfield arrangement that expresses 639 sustain pulses. Here, first sustain pulse subfield converter 442 converts to the subfield when the sustain pulse number is 640–1023 (which means the value determined by sustain pulse number determining portion 410 and output from inverse gamma corrector 430) by employing the sustain pulse subfield arrangement of arrangement A, and second sustain pulse subfield converter 444 converts to the subfield when the sustain pulse number is 256–639 (which means the value determined by sustain pulse number determining portion 410 and output from inverse gamma corrector 430) by employing the sustain pulse subfield arrangement of arrangement B. In that situation, the sustain pulse subfield arrangement as shown in FIG. 11 is only one example determined by the equation (2), and it can be understood by a person who has ordinary skill in the art that the value can be modified slightly.

In FIG. 11, the arrangement A can express all of the cases that the sustain pulse number is smaller than 1023. On the contrary, the arrangement B can express only the cases that the sustain pulse number is smaller than 639. Accordingly, the case that the sustain pulse number is smaller than 639 can be expressed by all of the arrangement A and the arrangement B shown in FIG. 11. However, the arrangement B is employed in the case that the number is smaller than 639 in consideration of pseudo-contour. When the arrangement B is employed, the pseudo-contour can be reduced much more when the difference of sustain pulse numbers between the respective subfields (especially between the subfields with many sustain pulses) is not great. FIG. 12 shows a coding table at the sustain pulse subfield arrangement of arrangement B.

In other words, sustain pulse subfield converter 440 in the controller 400 according to an exemplary embodiment of the present invention can reduce the pseudo-contour by operating at different ranges according to the sustain number with two sustain pulse subfield converters 442, 444 having the same subfield dividing numbers.

The exemplary embodiment of the present invention provides for the case in which the different sustain pulse subfield arrangements are applied to two of the divided sustain pulse groups, but the pseudo-contour can be reduced much more if three or more sustain pulse groups are formed by division. Even if sustain pulse subfield converter 440 is divided into three or more groups and the respective sustain pulse subfields are generated according to the sustain pulse numbers in the respective groups, the dividing numbers of subfields at the respective sustain pulse subfield converters are identical to each other.

Referring back to FIGS. 5 and 6, the subfield data (sustain pulse number data) with the subfield arrangement depending on the sustain pulse number converted by sustain pulse subfield converter 440 are transmitted to PDP driver 500, that is, address driver 200 and scan/sustain driver 300, and then displayed on plasma display panel 100.

As described above, according to the present invention the performance to express gray levels is improved and the pseudo-contour is reduced.

While the present invention has been described in connection with what is presently considered to be practical embodiments, it is to be understood that the invention is not limited to the disclosed embodiments, but, on the contrary, is intended to cover various modifications and equivalent arrangements included within the spirit and scope of the appended claims.

What is claimed is:

1. A driving apparatus for a plasma display panel that divides respective fields of an image displayed on the plasma display panel according to an input image signal into a plurality of subfields and displays the image corresponding to the image signal by expressing gray levels according to a combination of the subfields, the driving apparatus comprising:

a sustain pulse number determining portion that determines a sustain pulse number based on an average signal level of data in one frame of the input image signal;

an inverse gamma corrector that performs inverse gamma correction of the input image signal so that an inverse gamma correction gray level corresponding to the number of sustain pulses applied to the plasma display panel is expressed, by using a plurality of gamma correction tables corresponding to the sustain pulse number determined by the sustain pulse number determining portion;

a sustain pulse subfield converter that converts the subfield into the subfield depending on the sustain pulse number corresponding to the data output from the inverse gamma corrector by making the sustain pulse number in the respective subfields different from each other according to the sustain pulse number determined by the sustain pulse number determining portion; and a sustain/scan driver that generates control signals based on arrangement of the subfield converted by the sustain pulse subfield converter and applies the control signals to the plasma display panel.

2. The driving apparatus of claim 1, wherein the number of subfields converted by the sustain pulse subfield converter is determined according to a maximum sustain pulse number determined by the sustain pulse number determining portion.

3. The driving apparatus of claim 1, wherein the sustain pulse subfield converter includes a plurality of sustain pulse subfield converters for making the sustain pulse numbers at the respective subfields different from each other according to the sustain pulse number determined by the sustain pulse number determining portion.

4. The driving apparatus of claim 3, wherein the plurality of sustain pulse subfield converters operate according to groups of the sustain pulse numbers determined by the sustain pulse number determining portion.

5. The driving apparatus of claim 1, wherein when the sustain pulse number determined by the sustain pulse number determining portion is smaller in comparison with a case in which the sustain pulse number is greater, the sustain pulse numbers at the respective subfields converted by the sustain pulse subfield converter are smaller.

6. The driving apparatus of claim 1, wherein the sustain pulse number determining portion determines a small sustain pulse number in a case of a high average signal level, and a high sustain pulse number in a case of a low average signal level.

7. The driving apparatus of claim 1, wherein the plurality of gamma corrections are performed with reference to a plurality of gamma tables.

8. The driving apparatus of claim 1, wherein the plurality of gamma corrections are performed by a predetermined calculation.

9. A method for expressing gray levels of a plasma display panel that divides respective fields of an image displayed on the plasma display panel according to an input image signal into a plurality of subfields and displays the image corresponding to the image signal by expressing gray levels according to a combination of the subfields, the method comprising:

(a) determining a sustain pulse number based on an average signal level of data in one frame of the input image signal;

(b) performing inverse gamma correction of the input image signal so that an inverse gamma correction gray level corresponding to the number of sustain pulses applied to the plasma display panel is expressed, by using a plurality of gamma correction tables corresponding to a determined sustain pulse number;

(c) converting the subfield into the subfield depending on the sustain pulse number corresponding to output data having undergone the inverse gamma correction, by making the sustain pulse number in the respective subfields different from each other according to the determined sustain pulse number determined; and (d) controlling display on the plasma display panel so that an image corresponding to the subfield data generated is displayed on the plasma display panel.

10. The method of claim 9, wherein the number of subfields converted is determined according to a maximum sustain pulse number determined.

11. The method of claim 9, wherein when the sustain pulse number determined is smaller in comparison with a case in which the sustain pulse number is greater, the sustain pulse numbers at the respective subfields converted are smaller.

12. The method of claim 10, wherein the plurality of gamma corrections are performed with reference to a plurality of gamma tables.

* * * * *